United States Patent [19]

Strickland

[11] Patent Number: 4,877,128

[45] Date of Patent: Oct. 31, 1989

[54] BABY BOTTLE CADDY

[76] Inventor: Joyce M. Strickland, 100 West St., #103, Vernon, Conn. 06066

[21] Appl. No.: 274,364

[22] Filed: Nov. 21, 1988

[51] Int. Cl.[4] ..... B65D 71/00; B65D 81/18

[52] U.S. Cl. ..... 206/170; 62/371; 62/457.1; 206/541; 220/21; 220/469; 383/38

[58] Field of Search ..... 62/371, 372, 457, 530; 206/170, 171, 174, 427, 544, 545, 546, 549; 215/12.1, 13.1; 220/21, 403, 410, 412, 449, 469, 426; 224/148, 202, 214, 250, 257, 259

[56] References Cited

U.S. PATENT DOCUMENTS

| | | | |
|---|---|---|---|
| 2,123,031 | 7/1938 | Weiner | 220/412 |
| 2,496,296 | 2/1950 | Lobl | 220/412 |
| 2,979,227 | 4/1961 | Norton et al. | 62/457 |
| 3,242,960 | 3/1966 | Schwartzman | 220/410 |
| 3,443,397 | 5/1969 | Donovan | 62/457 |
| 3,614,875 | 10/1971 | McCallun | 383/38 |
| 4,286,440 | 9/1981 | Taylor | 62/457 |
| 4,292,817 | 10/1981 | Loucks | 62/457 |
| 4,295,345 | 10/1981 | Atkinson | 62/371 |
| 4,324,111 | 4/1982 | Edwards | 62/530 |
| 4,336,883 | 6/1982 | Krug et al. | 206/545 |
| 4,351,165 | 9/1982 | Gottsegen et al. | 62/371 |
| 4,537,313 | 8/1985 | Workman | 62/457 |
| 4,542,826 | 9/1985 | Adams | 383/38 |
| 4,782,945 | 11/1988 | Geiler et al. | 215/12.1 |
| 4,805,776 | 2/1989 | Namgyal et al. | 206/523 |

*Primary Examiner*—Jimmy G. Foster
*Attorney, Agent, or Firm*—Leon Gilden

[57] ABSTRACT

A baby bottle caddy carrying container is set forth wherein the container is formed with an interior flexible matrix of four compartments formed of wall structure of a flexible, relatively thin first thickness spaced from an exterior wall surface of a second greater thickness. The spacing between the first and second wall structure provides for acceptance of containers of cooling medium therewithin. The relatively thin first wall structure accommodates bottles of complementary square cross-sectional configuration wherein the bottles positionable within the matrix of compartments provide rigidity to the carrying case and accommodates varying size bottles to vary the spacing between the first and second walls. A third wall shell structure of a third thickness less than the first wall thickness is in surrounding relationship to provide strength and support to the carrying container of the instant invention.

10 Claims, 1 Drawing Sheet

BABY BOTTLE CADDY

BACKGROUND OF THE INVENTION

1. Field of the Invention

The field of invention relates to thermal transport devices, and more particularly pertains to a new and improved baby bottle caddy formed with compartments of square cross-sectional configuration to accommodate complementary shaped bottles of square cross-sectional configuration wherein the bottles provide rigidity to the carrying container when assembled within the compartments within the container.

2. Description of the Prior Art

The use of caddy devices of various types for transport of articles is well known, as is the need for providing a cooling medium during transport. Devices of the past, however, have been of either rigid wall construction to accommodate a cooling medium or when utilized as a flexible wall construction device, have failed to provide the rigidity desired in a carrying device, as does the instant invention. For example, U.S. Pat. No. 3,614,875 to McCallun sets forth a flexible carrying container including a plurality of compartments, but fails to provide the spacing accommodating a cooling medium or the use of complementary bottles of cross-sectional configuration to provide rigidity to the organization, as does the instant invention.

U.S. Pat. No. 4,286,440 to Taylor sets forth a cooler provided with a circular configuration of compartments of a relatively rigid construction, as opposed to the instant invention wherein the bottles and the like positioned within the compartments are not of complementary configuration with the compartments and fail to provide the carrying container rigidity as provided by the instant invention.

U.S. Pat. No. 4,295,345 to Atkinson sets forth a container formed with circular compartments to accommodate likeshaped containers, but does not provide the flexible wall construction to enable compact storage of the device when not in use, as does the instant invention, and further does not provide for the surrounding cooling medium, as does the instant invention.

U.S. Pat. No. 4,336,883 to Krug sets forth a further example of a rigid container providing storage compartments for a cooling medium and is typical of the prior art in relying on wall rigidity for integrity of the configuration during transport, as opposed to the instant invention.

U.S. Pat. No. 4,351,165 to Gottsegen sets forth a cooling container with a constant medium compartment provided therein and as typically set forth by such devices, relies on the rigid wall structure of the container, as opposed to the instant invention.

As such, there continues to be a need for a new and improved baby bottle caddy that addresses both the problem of flexible wall construction to enable storage of the device when not in use, and further provide for a rigid container construction to provide for ease of use and transport.

SUMMARY OF THE INVENTION

In view of the foregoing disadvantages inherent in the known types of bottle transport containers now present in the prior art, the present invention provides a baby bottle caddy wherein the same provides for flexible wall construction to enable ease of storage and collapse of the device when not in use, and further provides for a rigid carrying container when assembled with associated bottles of complementary square cross-sectional configuration. As such, the general purpose of the present invention, which will be described subsequently in greater detail, is to provide a new and improved baby bottle caddy which has all the advantages of the prior art bottle transport devices and none of the disadvantages.

To attain this, the present invention comprises a carrying container formed with an interior matrix of compartments defined by a first wall thickness of flexible construction spaced from a medial wall to provide a surrounding space for accommodation of a cooling medium container therein and further provided with a third wall of thickness formed of water impervious material and provided with carrying handles to surroundingly seal the interior thereof against moisture and thermal conductivity therethrough wherein the compartments of the instant invention are of square cross-sectional configuration to accommodate bottles of square cross-sectional configuration wherein when assembled provides rigidity to the structure to enable ease of transport and use and when disassembled, allows collapse of the carrying container for ease of storage thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baby bottle caddy which has all the advantages of the prior art baby bottle caddies and none of the disadvantages.

It is another object of the present invention to provide a new and improved baby bottle caddy which may be easily and efficiently manufactured and marketed.

It is a further object of the present invention to provide a new and improved baby bottle caddy which is of a durable and reliable construction.

An even further object of the present invention is to provide a new and improved baby bottle caddy which is susceptible of a low cost of manufacture with regard to both materials and labor, and which accordingly is then susceptible of low prices of sale to the consuming public, thereby making such baby bottle caddy economically available to the buying public.

Still yet another object of the present invention is to provide a new and improved baby bottle caddy which provides in the apparatuses and methods of the prior art some of the advantages thereof, while simultaneously overcoming some of the disadvantages normally associated therewith.

Still another object of the present invention is to provide a new and improved baby bottle caddy wherein the same is formed of a plurality of various wall thicknesses to accommodate bottles of complementary configuration to an interior matrix of compartments wherein when assembled, the carrying container is of rigid construction and when disassembled the carrying container is easily collapsed for storage thereof.

These together with other objects of the invention, along with the various features of novelty which characterize the invention, are pointed out with particularity in the claims annexed to and forming part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
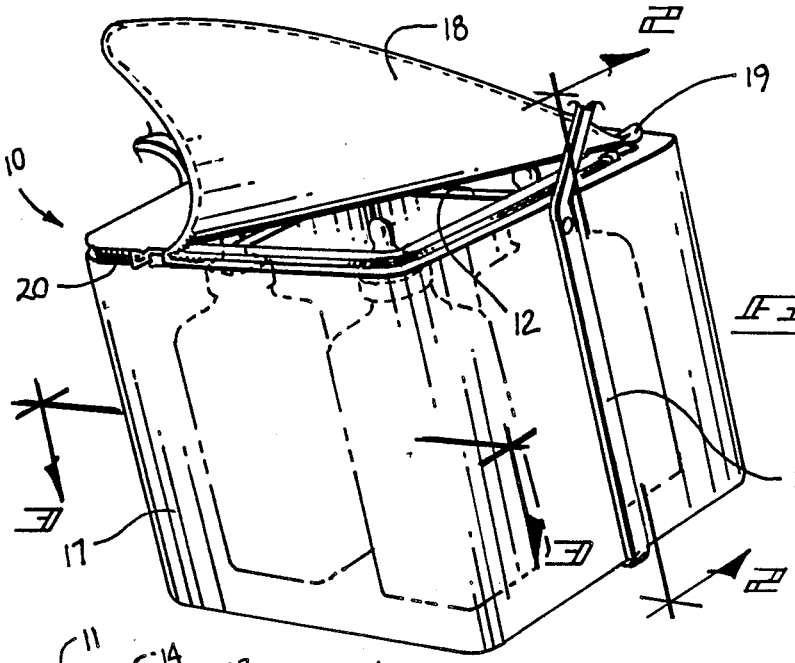
FIG. 1 is an isometric illustration of the instant invention.
Figure 3:
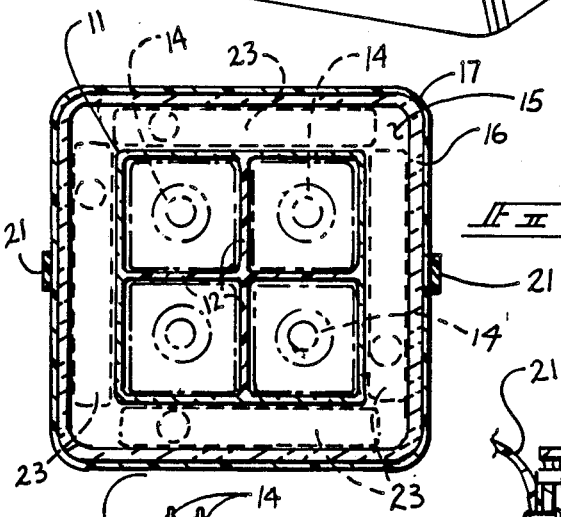
FIG. 3 is an orthographic view taken along the lines 3—3 of FIG. 1 in the direction indicated by the arrows.

With reference now to the drawings, and in particular to FIGS. 1 to 4 thereof, a new and improved baby bottle caddy embodying the principles and concepts of the present invention and generally designated by the reference numeral 10 will be described.

Figure 4:
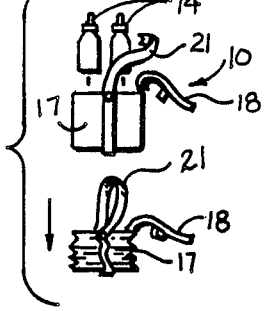
FIG. 4 is a diagrammatic orthographic illustration taken in elevation of the baby bottle caddy of the instant invention from a first extended position to a second collapsed position upon removal of the baby bottles therefrom.
Figure 2:
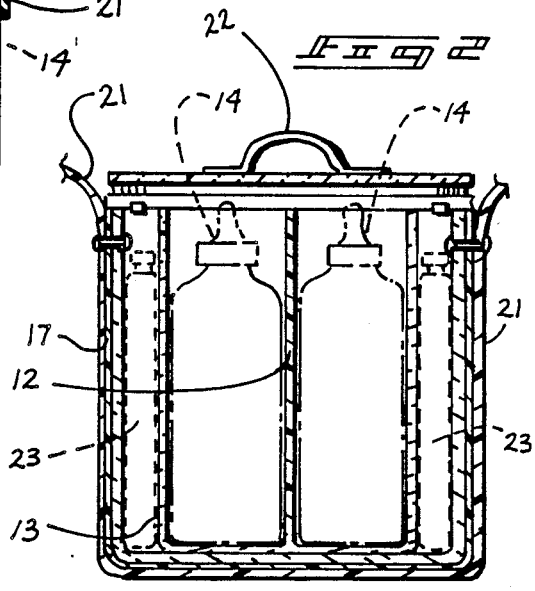
FIG. 2 is an orthographic view taken along the lines 2—2 of FIG. 1 in the direction indicated by the arrows.

More specifically, it will be noted that the baby bottle caddy 10 of the instant invention essentially comprises a carrying container formed with a first interior wall 11 of a first relatively thin thickness. The first interior wall 11 is formed of a polymeric flexible non-rigid material. The first interior wall 11 is formed with a plurality of orthogonally directed and arranged interior partitions 12 interiorly of the interior wall 11 to provide four compartments 11a of generally square cross-sectional configuration. The interior wall 11 is formed with an integrally formed floor 13 that is in turn integrally secured to a second cup-shaped intermediate portion 16 formed of a second wall thickness greater than that of the first wall thickness, and wherein the vertical sides of the cup-shaped portions 16 are spaced from the vertical walls 11 to define a cap 15 continuous about the perimeter of the first interior wall 11. The gap 15 accommodates a series of refrigerant containers 23 therewithin and effects continuous cooling of the bottles 14 positioned within the compartments **11*a*. The bottles 14 are formed of a rigid plastic-like material of complementary cross-sectional configuration and shape to the compartments 11*a* whereupon positioning of the bottles 14 within the compartments 11*a*, the baby bottle caddy 10 is maintained in an erected configuration whereupon removal of the baby bottles 14 removes all rigidity from the structure defined by the series of compartments and walls and effects collapse thereof, as illustrated in FIG. 4** for example.

A third exterior water impervious shell 17 is of a cup-shaped configuration and secured to an exterior surface of the second cup-shaped portion 16. The shell 17 includes a pivoted cover flap 18 seamed along a hinged end 19 with the three remaining ends securable to the shell 17 by a continuous zipper 20. An elongate first handle loop 21 is secured by means of separate through-extending connectors through the shell 17 and the second wall portion 16 to secure the bag's handle thereto with a second handle strip 22 also flexible construction secured to a top surface of the cover flap 18 to provide for alternative carrying by either the first or second handle 21 and 22 respectively.

It should be further noted that the third wall is defined by a wall thickness less than that of the first wall and provides a moisture barrier and supporting shell and further enhances insulation of the internal volume of the case formed by the first, second and third walls.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bottle caddy comprising, a first interior continuous wall integrally formed to a first floor portion, and a plurality of crossed partition walls integrally formed interiorly of a cavity defined by the interior wall and the first floor portion to define a plurality of compartments, and a second cup-shaped wall portion including an integrally formed second floor portion and a second vertical wall wherein said first floor portion is integrally secured to an upper surface of said second floor portion, and said second wall is spaced from said first interior wall to define a continuous gap therebetween, and a third cup-shaped wall portion including a hingedly mounted cover flap integrally secured to an exterior surface of said second wall portion, and a plurality of bottles receivable within said compartments to provide rigidity to said caddy.

2. A bottle caddy as set forth in claim 1 wherein said first floor portion, said second cup-shaped wall portion, and said third cup-shaped wall portion are each formed of flexible non-rigid polymeric material.

3. A bottle caddy as set forth in claim 2 wherein said first interior wall and said first floor portion are of an equal relatively thin wall thickness, and said second floor portion is formed of a second wall thickness substantially greater than said first wall thickness, and wherein said third cup-shaped wall portion is formed of a third wall thickness less than said first wall thickness.

4. A bottle caddy as set forth in claim 3 wherein said plurality of bottles are of equal number to said plurality of compartments, and said plurality of bottles are formed of rigid material to impart rigidity to said bottle caddy when said plurality of bottles are positioned within said compartments.

5. A bottle caddy as set forth in claim 4 wherein a first continuous loop handle is integrally secured by fasteners to said second cup-shaped wall portion and said third cup-shaped wall portion.

6. A bottle caddy as set forth in claim 5 wherein a second handle strip is secured to said cover flap.

7. A bottle caddy as set forth in claim 6 wherein said cover flap is fixedly secured along one end to said third cup-shaped wall portion at an upper terminal end of said third cup-shaped wall portion, and a remaining periphery of the cover flap is selectively securable to said third cup-shaped wall portion by a cooperating continuous zipper.

8. A bottle caddy as set forth in claim 7 wherein said plurality of compartments are defined by four compartments and said plurality of bottles are defined by four bottles.

9. A bottle caddy as set forth in claim 8 wherein said compartments and said bottles are of square cross-sectional configuration.

10. A bottle caddy as set forth in claim 9 wherein separate refrigerant containers are positionable within said gap to provide a cooling medium to said plurality of bottles when positioned within said plurality of compartments.

* * * * *